US010946247B1

(12) United States Patent
Burton

(10) Patent No.: US 10,946,247 B1
(45) Date of Patent: Mar. 16, 2021

(54) UNSTABLE SURFACE TRAINING APPARATUS AND METHOD OF USE THEREOF

(71) Applicant: Robert Burton, Hendersonville, TN (US)

(72) Inventor: Robert Burton, Hendersonville, TN (US)

( * ) Notice: Subject to any disclaimer, the term of this patent is extended or adjusted under 35 U.S.C. 154(b) by 103 days.

(21) Appl. No.: 15/706,318

(22) Filed: Sep. 15, 2017

Related U.S. Application Data

(60) Provisional application No. 62/495,486, filed on Sep. 15, 2016.

(51) Int. Cl.

| | |
|---|---|
| ***A63B 26/00*** | (2006.01) |
| ***A63B 22/00*** | (2006.01) |
| ***A63B 21/00*** | (2006.01) |
| ***A63B 71/00*** | (2006.01) |

(52) U.S. Cl.
CPC ..... *A63B 26/003* (2013.01); *A63B 21/4034* (2015.10); *A63B 21/4047* (2015.10); *A63B 22/0015* (2013.01); *A63B 22/0046* (2013.01); *A63B 71/0054* (2013.01); *A63B 2022/0092* (2013.01); *A63B 2071/0072* (2013.01)

(58) Field of Classification Search
CPC ..... A63B 26/003; A63B 71/0054; A63B 21/4047; A63B 22/0046; A63B 22/0015; A63B 21/4034; A63B 2022/0092; A63B 2071/0072; A63B 21/023; A63B 23/03525; A63B 21/00069; A63B 23/03541; A63B 21/055; A63B 2208/0204; A63B 21/068; A63B 2071/027; A63B 21/4033; A63B 22/16; A63B 22/0056
See application file for complete search history.

(56) References Cited

U.S. PATENT DOCUMENTS

| | | | | | |
|---|---|---|---|---|---|
| 3,416,792 | A | * | 12/1968 | Morgan | A63B 22/16 482/146 |
| 3,511,500 | A | * | 5/1970 | Dunn | A63B 21/015 482/113 |
| 3,544,103 | A | | 12/1970 | Conable | |
| 3,659,844 | A | * | 5/1972 | Cummins | A63B 21/023 273/DIG. 8 |
| 4,270,749 | A | * | 6/1981 | Hebern | A63B 22/16 482/146 |
| 4,319,746 | A | * | 3/1982 | Chang | A63G 11/00 472/4 |

(Continued)

*Primary Examiner* — Andrew S Lo
(74) *Attorney, Agent, or Firm* — Patterson Intellectual Property Law, P.C.; Mark A. Kilgore

(57) ABSTRACT

The present disclosure relates, in one embodiment, to an unstable surface training apparatus. The apparatus may include a platform that is pivotally connected to a support member about the pivot axis. The apparatus may include at least one user handle that is adjustably connected to the platform. The platform may be freely pivotable about the pivot axis up to a maximum degree of rotation. Some embodiments of the exercise apparatus may include an base upon which the support member is connected. The base provides the exercise apparatus with increased stability. Other embodiments of the exercise apparatus may include a rotational restriction assembly disposed between the support member and the platform for limiting the maximum degree of rotation.

16 Claims, 4 Drawing Sheets

(56) References Cited

U.S. PATENT DOCUMENTS 4,505,477 A * 3/1985 Wilkinson ..... A63B 22/16 280/87.041
4,694,684 A * 9/1987 Campbell, III ..... A63C 11/26 280/809
4,787,630 A * 11/1988 Watson ..... A63B 22/14 482/146
4,822,039 A * 4/1989 Gonzales ..... A63B 21/04 482/128
5,447,474 A * 9/1995 Chang ..... A63G 1/32 472/106
5,518,470 A 5/1996 Piaget et al.
5,713,823 A * 2/1998 Walendzak ..... A63B 22/18 482/139
5,755,651 A * 5/1998 Homyonfer ..... A63B 22/16 482/123
5,807,210 A * 9/1998 Devlin ..... A63B 22/0056 482/146
5,851,166 A * 12/1998 Bernardson ..... A63B 22/16 482/79
5,951,406 A * 9/1999 Steane ..... A63G 11/00 434/194
6,312,365 B1 * 11/2001 Koenig ..... A63B 21/0615 482/93
6,709,367 B1 * 3/2004 Liang ..... A63B 22/0058 482/146
6,752,747 B2 * 6/2004 Yu ..... A63B 21/00043 482/110
7,052,449 B2 5/2006 Chen
7,090,628 B2 8/2006 Badameh
7,625,294 B1 * 12/2009 Isaac ..... A63B 69/3667 473/218
7,645,221 B1 * 1/2010 Curry ..... A63B 21/023 482/142
7,803,096 B2 * 9/2010 Mehta ..... A63B 22/14 482/112
8,147,391 B1 * 4/2012 Hill ..... A63B 21/4035 482/132
8,444,498 B2 * 5/2013 Grossman ..... A63G 11/00 472/106
9,931,540 B1 * 4/2018 Lazar ..... A63B 26/003
2002/0077231 A1 * 6/2002 Dalebout ..... A63B 22/18 482/146
2003/0017922 A1 * 1/2003 Sachs ..... A63B 26/003 482/146
2005/0164844 A1 * 7/2005 Johnson ..... A63B 22/16 482/79
2007/0298947 A1 12/2007 Eksteen
2010/0197417 A1 * 8/2010 May ..... A63G 1/32 472/106
2012/0058865 A1 * 3/2012 Scimone ..... A63B 21/00069 482/129
2012/0184412 A1 * 7/2012 Glaner ..... A63B 69/18 482/30
2013/0316885 A1 * 11/2013 Harwin ..... A63B 26/003 482/142
2014/0045664 A1 * 2/2014 Hockridge ..... A63B 26/00 482/142
2014/0349823 A1 * 11/2014 Knox ..... A63B 23/1236 482/141
2014/0371041 A1 * 12/2014 Terpstra ..... A63B 22/18 482/146
2016/0250513 A1 * 9/2016 Ho ..... A63B 21/4045 482/127
2016/0317863 A1 * 11/2016 Goldberg ..... A63B 21/0087
2017/0209745 A1 * 7/2017 Kramer ..... A63B 21/00058
2017/0232302 A1 * 8/2017 Dedvukaj ..... A63B 26/003 482/123

* cited by examiner

UNSTABLE SURFACE TRAINING APPARATUS AND METHOD OF USE THEREOF

CROSS-REFERENCES TO RELATED APPLICATIONS

This application claims benefit of the following patent application(s) which is/are hereby incorporated by reference: U.S. 62/495,486 filed Sep. 15, 2016

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

BACKGROUND

The present invention relates generally to exercise equipment used as a therapy in rehabilitation and prehabilitation. More particularly, the present invention relates to an unstable surface training apparatus that may enhance static and dynamic balance, agility, strength, speed, and intramuscular and intermuscular coordination of the user.

Balance boards are known in the art. A balance board is a labile surface with which unstable surface training can be accomplished. Balance boards may be classified according to two parameters: (1) whether the fulcrum is attached or unattached to the board; and (2) the degree of movement. Under parameter (2), the degree of movement is based on whether the board moves in only two opposite directions (i.e. side to side, or front to back) or moves in all directions (i.e. 360 degrees). The degree of movement as well as the speed of movement is what creates the instability of the board.

A number of variations using a labile surface are known in the art. One of the main uses for these types of devices is for improving proprioception. Most variations include boards which an individual stands on and tries to balance on the fulcrum so as to not allow the board to touch the ground. Most are commonly used for ankle or leg injuries. Use of the board may help strengthen ligaments and muscles, may enhance proprioception and balance, may enhance coordination, and may also develop core strength.

Such devices known in the art may be used for a wide variety of patients and individuals. These types of boards may be used by physical therapists as part of a treatment regimen, or may be used by individuals in their own homes as part of physical training. They also are useful because they can be used by a wide age range of individuals, including from children to the elderly. In recent years, these devices have been used by athletes to aid in injury prevention as well as coordination and stability.

In one instance, a balance board may have a platform that has a fixed fulcrum secured to the underside of the platform and only allows for movement in opposing directions. These devices are known more generally as rocker boards, and require less skill to operate. A rocker board generally has a circular fulcrum which creates a curvilinear path of motion as the platform rotates. The circular fulcrum determines the vertical displacement of the board in relation to the ground. As the board rotates on the circular fulcrum, the rotation quality is directly related to the circumference of the fulcrum.

Similarly, a balance board may have a platform that rests on a hemisphere, or some variation thereof, that is connected to the board, this device being known as a wobble board. A wobble board allows for movement of the platform in all directions, front to back, side to side, and in diagonal directions. A wobble board generally requires a more skilled user since the user must balance in all directions rather than just two opposite directions like front to back or side to side of a rocker board. One issue with such a device is that the shape of a hemisphere determines the vertical displacement of the board in relation to the ground. The circumference of the hemisphere of the fulcrum will determine the vertical distance the board can travel.

Another balance board device, known as a roller board, generally has a platform which rests on a ball or cylinder. This configuration allows the platform to roll over the ball or cylinder, therefore the ball or cylinder does not act solely as a fixed fulcrum, but also acts as a point of movement for the platform. These freely movable devices require advanced skill and are not easily adaptable to all ages or injuries. Further, many of the balls or cylinders may become warped over time from prolonged use, thus effecting the quality of the rotation and/or movement of the platform. Additionally, the use of a roller board, as well as a wobble board, may be dangerous to unskilled users. Injury may occur to a user by falling off of the board, or by incorrectly using the board as intended and thus, instead of preventing or treating an injury, the user sustains an injury solely from use of the board.

What is needed, therefore, is an apparatus that is designed to overcome some of the above described limitations.

BRIEF SUMMARY OF THE INVENTION

Briefly, the present disclosure relates, in one embodiment, to an exercise apparatus. The exercise apparatus may include a support member, an intermediate member pivotally connected to the support member about a pivot axis; and at least one user engagement member adjustably connected to the intermediate member.

The intermediate member may have a maximum threshold angle with which it can rotate about the pivot axis.

In one embodiment, the exercise apparatus may include an elongate base attached to the support member to increase stabilization of the apparatus.

In a further embodiment, the intermediate member may include at least one vertical plate which may extend parallel with the support member.

The apparatus may include a rotational restriction assembly between the support member and the intermediate member.

The rotational restriction assembly may include a plurality of apertures defined in the support member. It may also include a lock pin which may be connected to the vertical plate of the intermediate member. The lock pin may be configured to engage a given aperture of the plurality of apertures.

The plurality of apertures may include at least one arcuate slot.

The rotational restriction assembly may include a plurality of apertures that are defined in the vertical plate of the intermediate member. Further, a lock pin may be connected to the support member, wherein the lock pin may be configured to engage a given aperture of the plurality of apertures.

In one embodiment, the apparatus may include at least one user engagement stabilization handle connected to the base. The handle attaches and extends upwardly from the base.

The stabilization handle may include a first handle and a second handle. The first stabilization handle may be attached to one corner of the base, and the second stabilization handle may be attached to another corner of the base. The corners may be on the same side of the intermediate member with respect to the length of the intermediate member.

In one embodiment, the intermediate member may have a length perpendicular to a pivot axis. Further, the intermediate member may include a row of holes defined in the intermediate member, wherein the holes may extend along a portion of the length of the intermediate member.

In one embodiment, at least one pin may be connected to the user engagement member and may be configured to occupy a given hole of the row of holes defined in the intermediate member.

The user engagement member may include at least one mounting extension and a handle that is attached to the mounting extension.

The mounting extension may include a first extension and a second extension, wherein the first extension is connected to a handle and the second extension is connected to the opposite side of the handle.

The user engagement member may include a second handle attached to the first mounting extension, wherein the second handle may be positioned at an angle relative to the first handle.

In one embodiment, the apparatus may include an intermediate member which is biased toward a rest position.

The intermediate member may be biased toward a rest position by use of at least one spring.

The intermediate member may have a plurality of connection points so that the spring may be configured to connect to the intermediate member at a given connection point of the plurality of connection points.

In one embodiment, the present disclosure relates to a method of adjusting an exercise apparatus for unstable surface training. The method may include providing an intermediate member that may pivot about an axis. The intermediate member may include a length that extends perpendicular to the pivot axis. The method may include providing at least one user engagement member that may be disposed on the intermediate member. The method may include moving the user engagement member along the length of the intermediate member from a first position to a second position. Finally, the method may include securing the user engagement member in the second position.

The method may further include freeing the user engagement member from the first position.

DETAILED DESCRIPTION OF THE INVENTION

Figure 1:
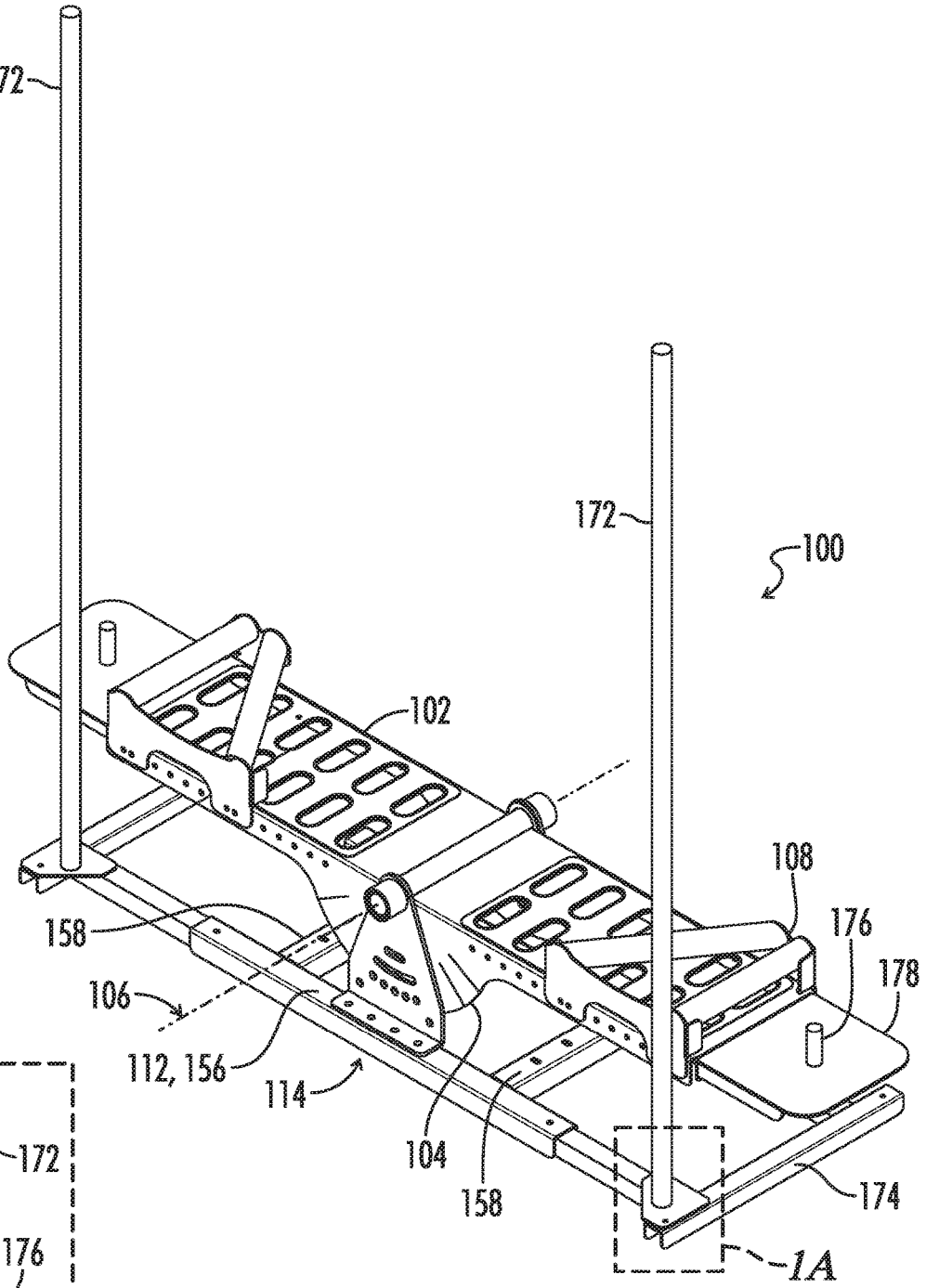
FIG. 1 is a perspective view of an exercise apparatus used in unstable surface training.

Reference will now be made in detail to embodiments of the present disclosure, one or more drawings of which are set forth herein. Each drawing is provided by way of explanation of the present disclosure and is not a limitation. In fact, it will be apparent to those skilled in the art that various modifications and variations can be made to the teachings of the present disclosure without departing from the scope of the disclosure. For instance, features illustrated or described as part of one embodiment can be used with another embodiment to yield a still further embodiment.

Thus, it is intended that the present disclosure covers such modifications and variations as come within the scope of the appended claims and their equivalents. Other objects, features, and aspects of the present disclosure are disclosed in, or are obvious from, the following detailed description. It is to be understood by one of ordinary skill in the art that the present discussion is a description of exemplary embodiments only and is not intended as limiting the broader aspects of the present disclosure.

The words "connected", "attached", "joined", "mounted", "fastened", and the like should be interpreted to mean any manner of joining two objects including, but not limited to, the use of any fasteners such as screws, nuts and bolts, bolts, pin and clevis, one or more sections of hooks and corresponding one or more sections of loops, ribbons, laces, ropes, buttons, and the like allowing for a stationary, translatable, or pivotable relationship; welding of any kind such as traditional MIG welding, TIG welding, friction welding, brazing, soldering, ultrasonic welding, torch welding, inductive welding, and the like; using any resin, glue, epoxy, and the like; being integrally formed as a single part together; any mechanical fit such as a friction fit, interference fit, slidable fit, rotatable fit, pivotable fit, and the like; any combination thereof; and the like.

Referring initially to FIGS. 1-4, an embodiment of an exercise apparatus 100 includes an intermediate member 102 pivotally connected to a support member 104 about a pivot axis 106, and at least one user engagement member 108 that is adjustably connected to the intermediate member. The intermediate member 102 may be freely pivotable about the pivot axis 106 up to a maximum threshold angle 110. Some embodiments of the exercise apparatus 100 may include an elongate base 112 upon which the support member 104 is connected. The elongate base 112 provides the exercise apparatus 100 with increased stability. Other embodiments of the exercise apparatus 100 may include a rotational restriction assembly 114 disposed between the support member 104 and the intermediate member 102 for limiting the maximum threshold angle 110. The exercise apparatus 100 in whole, or in part, may be made of any suitable material including, but not limited to, metals, alloys, polymers, and the like.

When the intermediate member 102 is freely pivotable around the pivot axis 106, the maximum threshold angle 110 is equal to the angle between a horizontal plane incident with the pivot axis and the intermediate member 102 when the intermediate member has an end in contact with a surface on which the support member 104 sits or a portion of the elongate base 112.

Figure 3:
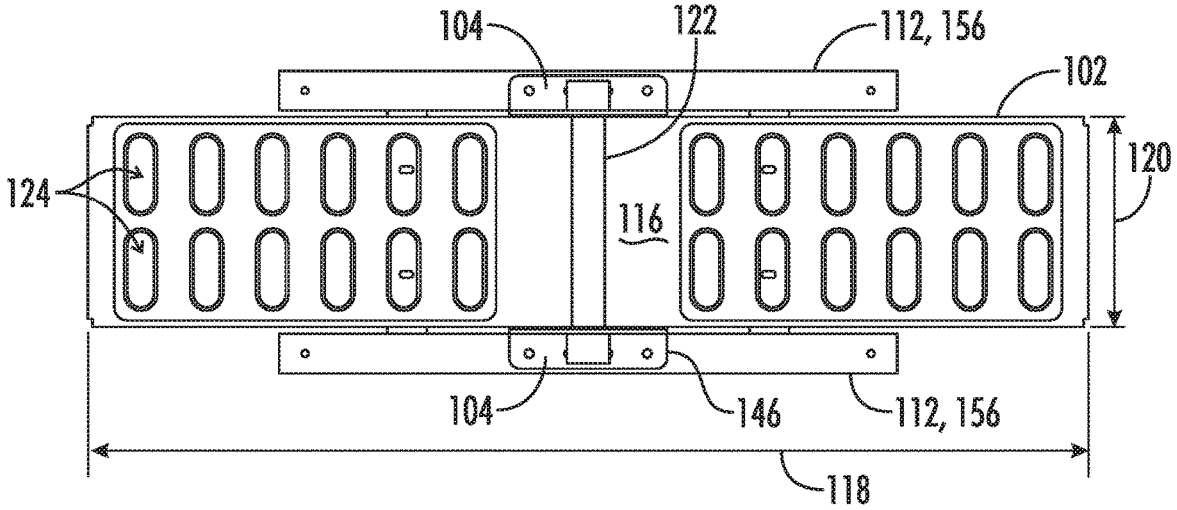
FIG. 3 is a top view of the exercise apparatus as shown in FIG. 2.

Referring to FIG. 3, an embodiment of the intermediate member 102 includes a flat upper surface 116, a length 118, and a width 120. The intermediate member 102 may include a pivotal connection member 122. The pivotal connection member 122 is arranged perpendicular to the length 118 of the intermediate member 102. The flat upper surface 116 may include two rows of oval-shaped apertures 124, the apertures may reduce weight or increase friction when a user engages the exercise apparatus 100 in an upright position. In some embodiments, the flat upper surface 116 may include a non-slip material disposed thereon. In other embodiments, the flat upper surface 116 may be made of diamond plate, have ridges laser cut, or the like. In other embodiments the flat upper surface 116 may be solid with no apertures.

In an alternative embodiment, the intermediate member 102 may include handle rails along the length, end rails connecting the handle rails together at their ends perpendicular to the length, the pivotal connection member 122 attached between the handle rails, and the at least one user engagement member 108 adjustably connected to the handle rails between the pivotal connection member 122 and one of the end rails. In other embodiments, the end rails may be angled relative to the handle rails.

Figure 4:
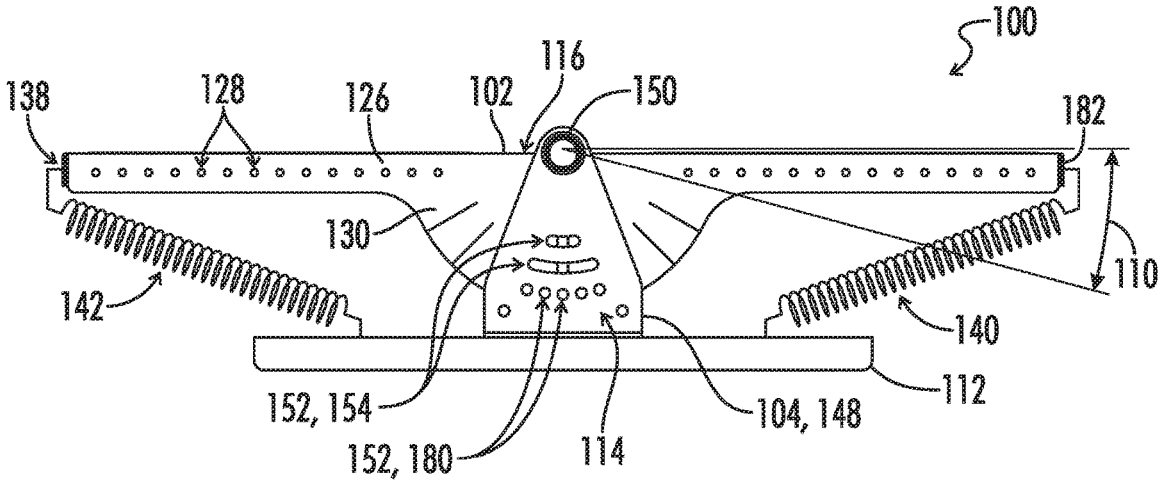
FIG. 4 is a side view of the exercise apparatus as shown in FIG. 2.

Referring now to FIG. 4, the intermediate member 102 may further include edge portions 126 extending below the flat upper surface 116, the edge portions being perpendicular to the flat upper surface in some embodiments. The intermediate member 102 may include holes 128 defined in the edge portions 126. A row of holes 128 may extend along a portion of the length 118 of the intermediate member 102. The edge portions 126 with holes 128 may be used to attach the at least one user engagement member 108 to the intermediate member 102. The edge portions 126 may serve to increase the strength of the intermediate member 102 and prevent it from flexing when the exercise apparatus 100 is engaged by a user.

Figure 5:
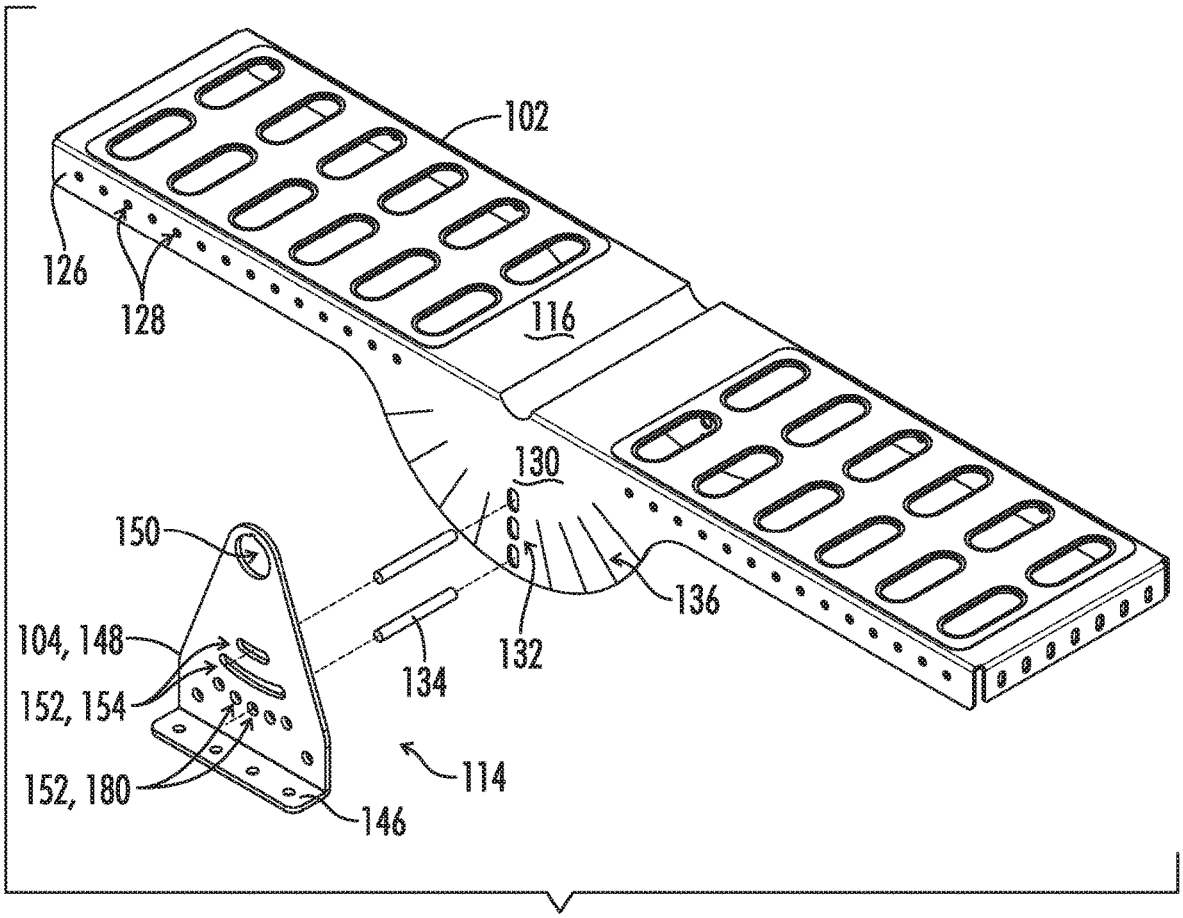
FIG. 5 is an exploded view of the support member, rotation restriction assembly, and intermediate member.

Referring now to FIG. 5, in certain embodiments, the intermediate member 102 may include at least one vertical plate 130. In one embodiment, the at least one vertical plate 130 may be defined on the edge 126. The at least one vertical plate 130 is one member of the rotational restriction assembly 114 as identified in FIGS. 1 and 5. The at least one vertical plate 130 may include at least one hole 132 for receiving a lock pin 134. The shape of the at least one vertical plate 130 of the intermediate member 102 may differ in other embodiments (e.g., non-semi-circular, square, triangular, or the like).

In another embodiment, the vertical plate 130 may include at least one surface indicia 136. The surface indicia 136 may be used to identify the maximum threshold angle 110, or may be used to set the intermediate member 102 at a certain angle during use. The surface indicia 136 may be a groove that is cut into the vertical plate 130 or may be a sticker or other adhesive material that is disposed on the plate. In another embodiment, the surface indicia may 136 may be painted onto the vertical plate 136, or may be a raised or indented portion of the plate, or the like.

In some embodiments, the intermediate member 102 may include a plurality of attachment points 138 (see FIG. 2) along an end wall 182 that is perpendicular to the width 120 of the flat upper surface 116. The plurality of attachment points 138 may be used for biasing the intermediate member 102 toward a rest position. By biasing the intermediate member 102, the intermediate member will resist angular acceleration, thereby offering additional assistance to the user. The rest position can be set at any angle, but is generally set at a horizontal neutral angle which may include the upper surface 116 being generally parallel with the elongate base 112 or some other surface on which the apparatus 100 rests. Biasing the intermediate member 102 may be accomplished by attaching a first spring 140 to the intermediate member 102 and the elongate base 112 on one side of the pivot axis 106. A second spring 142 may be attached to the intermediate member 102 and the elongate base 112 on the opposite side of the pivot axis 106 from the first spring 140. The amount of assistance supplied by the springs 140, 142 may be determined by the distance from an attachment point 138 to the elongate base 112.

Some embodiments may allow for the springs 140, 142 to optionally be attached to the intermediate member 102 in one or more of the holes 128. Alternatively, in one embodiment, the springs 140, 142 may be attached to the underside of the intermediate member 102. In certain embodiments, the springs 140, 142 may be symmetrically attached or asymmetrically attached. When the springs 140, 142 are symmetrically attached to the intermediate member 102 the rest position will be set at the horizontal neutral angle. When the springs 140, 142 are asymmetrically attached to the intermediate member 102 the rest position may be angled with respect to the horizontal neutral angle. In some embodiments, the springs 140, 142 may connect the intermediate member 102 and the support member 104. The bias supplied by the springs 140, 142 may assist a user in maintaining balance and can be removed once the user has become more skilled with the exercise apparatus 100. In some embodiments, the first and second springs 140, 142 may include compression springs. In other embodiments, the springs 140, 142 may include shocks, elastic bands, rubber bands, or the like.

In certain embodiments, the support member 104 may include at least one vertical support plate 148. In some embodiments, each vertical support plate 148 may include a bottom flange 146 positioned perpendicular to the support plate for connecting the support plate to a surface or the elongate base 112. (See FIG. 2) In one embodiment, two vertical support plates 148 are positioned on an intermediate member 102 opposite each other. In some embodiments, the support member 104 could comprise a solid structure positioned directly below the intermediate member 102. In other embodiments, the support member 104 could be C-shaped, including a single vertical support member with a bottom flange extending under the width of the intermediate member 102, and connected to one edge of the intermediate member such that the intermediate member is cantilevered on the support member.

In some embodiments, the apparatus 100 comprises a pivotal connection member 122 wherein the pivotal connection member is a pipe that may be secured to the intermediate member 102. A smaller diameter pipe may be inserted through the pivotal connection member 122, and secured to the support member 104 by a bushing disposed between the smaller and larger diameter pipes. The vertical support member 148 may include a pipe hole 150 aligned with the larger diameter pipe secured to the intermediate member 102. The smaller diameter pipe is generally aligned with the pivot axis 106. In some embodiments, the bushing may be a silicon bushing, a ball-bearing bushing, or the like. In other embodiments, the apparatus 100 has no bushing. In some embodiments, the support member 104 may be secured to the intermediate member by a nut and bolt, threaded shaft, tension-nut, or the like. The use of a nut and bolt, threaded shaft, tension nut, or the like may be useful in adjusting the force that is required to rotate the intermediate member 102 about the pivot axis 106. Increased tension will increase the amount of force required to rotate the intermediate member 102 and thus, will provide more stability for a user.

The bottom flange 146 of the one or more vertical support plates 148 may be connected to the elongate base 112. In an alternative embodiment, the bottom flanges 146 of the support plates 148 could extend under the intermediate member 102 and be connected forming a single unitary body. In other embodiments, the support member 104 may be composed of a vertical plate or structure with no flange extending therefrom.

In certain embodiments, the support member 104 may further include a plurality of apertures 152 defined in each vertical support member 104. The plurality of apertures 152 may make up part of the rotational restriction assembly 114. The plurality of apertures 152 may include at least one arcuate slot 154 centered about the pivot axis 106 through holes, indentations, rails, pins, or the like.

As shown in FIG. 5, in some embodiments, the rotational restriction assembly 114 may include a locking pin 134, a plurality of apertures 152 and slots 154 defined in the support member 104, and holes 132 defined in the vertical plate 130 of the intermediate member 102. The lock pin 134 engages a given aperture of the plurality of apertures 152, 154 of the support member 104 and a corresponding hole 132 of the intermediate member 102. When the lock pin 134 is engaged in a lock aperture 180 and a corresponding hole 132 of the intermediate member 102, the intermediate member is effectively stationary and fixed at an angle. When the lock pin 134 is engaged in a first arcuate slot 154 and corresponding hole 132 of the intermediate member 102, the maximum threshold angle 110 of the intermediate member 102 is effectively limited by an arc length of the first arcuate slot 110. In an alternative embodiment, the apertures 152 on the support member 104 and the holes 132 on the vertical plate 130 of the intermediate member 102 could be reversed, thus the semi-circular plate of the intermediate member could include the plurality of apertures including the at least one arcuate slot and the support member could include the holes. Additionally, the lock aperture 180 and locking pin 134 may be circular, oval, square, star-shaped, or the like, so that the locking pin may be inserted into the lock aperture.

In an alternative embodiment, the rotation restriction assembly 114 may include a rod or similar structure that stands in a vertical plane, or substantially vertical plane, as compared to the base 112. The rod or similar structure may be attached to the base 112 or may be positioned separately on the ground. The rod may be positioned under the intermediate member 102 so as to restrict the movement of the intermediate member when the intermediate member comes into contact with the rod. Additionally, the rod or similar structure could be moved toward or away from the pivot axis 106 so as to increase, if moved toward, or decrease, if moved away, the angle of rotation 110 of the intermediate member 102. In addition to a rod, other structures such as a shock may be used.

In certain embodiments, the exercise apparatus 100 may include the elongate base 112 to increase stability while maintaining the mobility of the exercise apparatus. When utilizing the rotational restriction assembly 114, the elongate base 112 may prevent the support member 104 from tipping over when the maximum threshold angle 110 is limited or when the intermediate member 102 is stationary or fixed at a specific angle. The elongate base 112 may include two parallel base members 156 aligned with the intermediate member 102 along its length 118 and each base member may be attached to one of the vertical support plates 148 of the support member 104. The elongate base 112 may include two cross members 158 attached between the parallel base members 156. The two cross members 158 may be perpendicular to the parallel base members 156 or may be angled with respect to the parallel base members 156.

In one embodiment, the two cross members 158 may include attachment holes 160 for attaching the exercise apparatus to an overhead structure or for suspending the apparatus in the air by straps. In another embodiment, the attachment holes 160 may be used when biasing the intermediate member 102 with springs 140, 142.

In yet another embodiment, the parallel base members 156 may include slots aligned with the cross members 158 to put an additional length of pipe to serve as outriggers for further increased stability. Alternatively the slots may interface with other devices to suspend the exercise apparatus 100 in mid-air or overhead. In some embodiments, the elongate base 112 may comprise a solid plate. In other embodiments, the elongate base 112 may include additional holes for auxiliary attachments and additional support members. In yet other embodiments, the base 112 may be oriented different than the illustrated embodiment. For example, the base 112 may be substantially perpendicular to the intermediate member 102.

Figure 6:
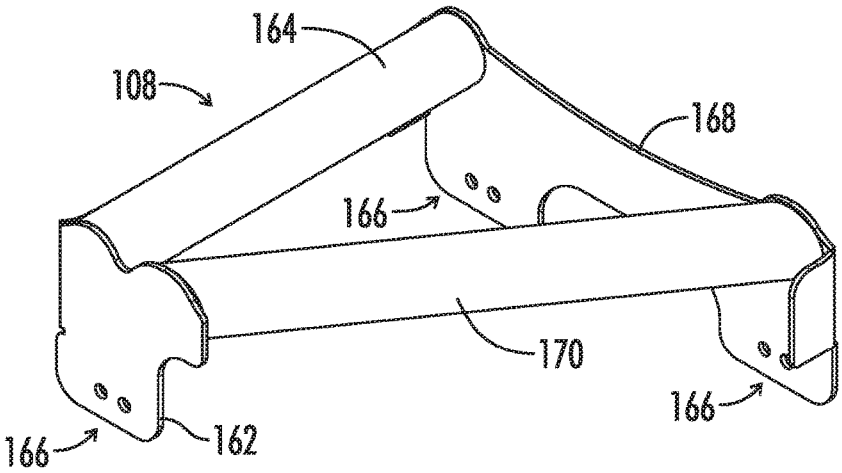
FIG. 6 is a perspective view of the user engagement member.

Referring now to FIG. 6, one embodiment of the exercise apparatus 100 may include at least one user engagement member 108 adjustably mounted to the intermediate member 102. The at least one user engagement member 108 includes at least one mounting extension 162 and a first handle 164 attached to the first mounting extension. In one embodiment, the first handle 164 may be perpendicularly mounted to the first mounting extension 162. In another embodiment, the user engagement member 108 includes a second mounting extension 168. The first handle 164 may be connected to the first mounting extension 162 and the second mounting extension 168. A mounting extension may, in some embodiments, include mounting holes 166 along a bottom edge and arranged to align with the holes 128 on the edge portion 126 of the intermediate member 102. The user engagement member 108 may include at least one pin configured to occupy a mounting hole 166 and a corresponding hole of the row of holes 128 defined in the intermediate member 102.

Another embodiment may include a first handle 164 and a second handle 170 mounted to the same at least one mounting extension 162, 168. The first handle 164 of the user engagement member 108 may be connected perpendicularly, or substantially perpendicularly, between the first mounting extension 162 and second mounting extension 168. The second handle 170 may be positioned at an angle relative to the first handle 164 and be connected between the first mounting extension 162 and second mounting extension 168. The design of each of the mounting extensions 162, 168 may allow the user engagement devices to be detached, rotated 180 degrees, and then reattached. This design allows a user to more finely adjust the distance of the first and second handles 164, 170 from the pivot axis 106. The design also enables the user to engage the handles 164, 170 at three different angles. The three different engagement angles are advantageous over the prior art because the angles of the handles 164, 170 allows the user to engage the apparatus 100 with shoulders internally rotated, externally rotated, or in the neutral position, all while maintaining a neutral wrist. This allows the user to isolate specific muscles for rehabilitation or prehabilitation, while also protecting the wrists from strain or injury.

In some embodiments, the first mounting extension 162 may have a shorter length than the second mounting extension 168. It will be obvious to a person having skill in the art that the length of the mounting extensions 162, 168 may be adjusted based on the desired angles of the user engagement handles. Likewise, further embodiments may use more than two handles, and could use as many handles as may be spaced along the length of the intermediate member 102. Thus, the length of the mounting extension may be adjusted based on the needs of the user and the handle spacing.

In some embodiments, the user engagement members 108 may be adjustable along rails or slots. The user engagement members 108 may be mounted or secured by nuts and bolts, a friction lock, a locking pin, or the like.

Figure 1A:
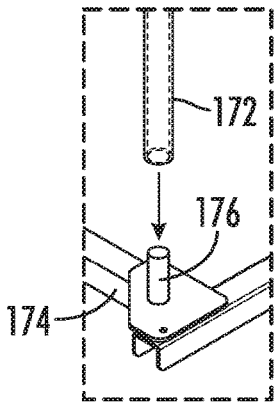
FIG. 1*a* is an enlarged view of a portion of FIG. 1.
Figure 2:
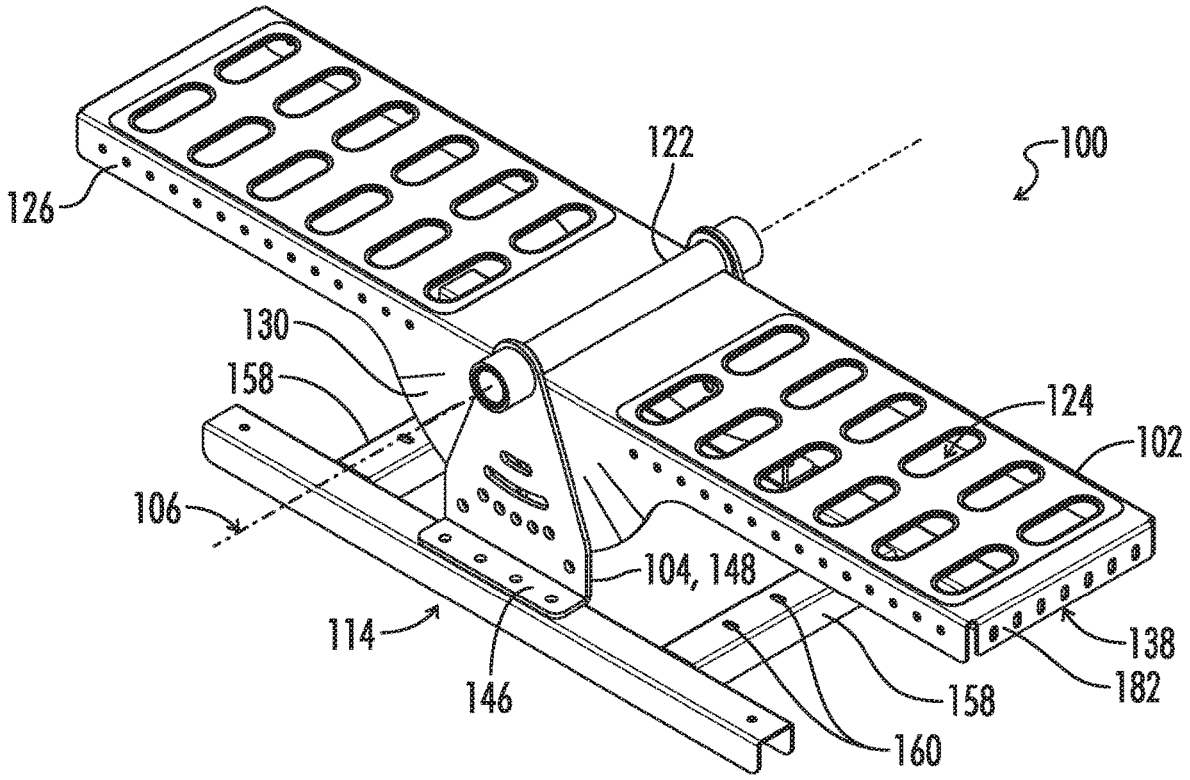
FIG. 2 is a perspective view of the exercise apparatus of FIG. 1 without various components.

FIG. 1 and FIG. 1*a* illustrates an embodiment of the exercise apparatus 100 which may include user stabilization handles 172 for assisting a user when utilizing the apparatus in a standing position. The user stabilization handles 172 can be attached to the elongate base 112 using a base attachment portion 174 having a male protrusion 176 for receiving the user stabilization handle 172. The base attachment portion 174 is attached to the base 112 using bolts or the like, or may be integrally formed with the base. In some embodiments, the base attachment mechanism 174 with user stabilization handles 172 is attached to two corners of the elongate base 112 on the same side of the intermediate member 102. Some embodiments may include the user stabilization handles 172 integrally formed with the base 112. Other embodiments may include a male protrusion 176 wherein the protrusion portion is threaded so as to receive a stabilization handle 172 that has complimentary threads and may be screwed onto the male protrusion.

In an alternative embodiment, the user stabilization handles 172 may be attached to the intermediate member 102 using an intermediate attachment extension 178 having the male protrusion 176 for receiving the user stabilization handle 172. In some embodiments, the intermediate attachment extension 178 may be attached to an end of the intermediate member 102 using similar mounting extensions and pins as the user engagement member 108 discussed prior. In other embodiments, the intermediate member 102 may include a row of end holes along each edge portion parallel with the width of the intermediate member, wherein the attachment extension 178 may be attached to an end of the intermediate member utilizing the row of end holes and at least one attachment point along the edge portion parallel with the length of the intermediate member. In some embodiments, the attachment extension 178 may be integrally formed with the intermediate member 102. At least one embodiment may include the user stabilization handles 172 integrally formed with the intermediate member 102. In other embodiments the user stabilization handles 172 may be attached to a male protrusion disposed on the user engagement member. In other embodiments, the user stabilization handles 172 may be inserted into a female receptacle on any of the prior attachment mechanisms discussed. Likewise, it is obvious to a person having ordinary skill in the art that a male protrusion or female receptacle may be used in any form known in the art to stabilize a mechanism such as the stabilization handles.

A method may begin by providing an intermediate member 102 that is pivotable about a pivot axis 106. The intermediate member 102 may include a length 118 that extends perpendicular to the pivot axis 106. At least one user engagement member 108 may be provided, the user engagement member may be disposed on the intermediate member 102. The user engagement member 108 may be freed from a first position. The user engagement member 108 may be moved along the length 118 of the intermediate member 102 from the first position to a second position. Finally, the user engagement member 108 may be secured in the second position on the intermediate member 102. In some embodiments, the user engagement member 108 may be rotated 180 degrees in order to move along the length 118.

Thus, although there have been described particular embodiments of the present invention of a new and useful UNSTABLE SURFACE TRAINING AND METHOD OF USE THEREOF, it is not intended that such references be construed as limitations upon the scope of this invention except as set forth in the following claims.

What is claimed is:

1. An exercise apparatus for unstable surface training comprising:

a support member;

an intermediate member having an upper surface that is flat, the intermediate member being pivotally connected to the support member about a pivot axis, through a pivotal connection member, the pivotal connection member coupled to the support member and arranged perpendicularly in contact with the intermediate member such that the pivotal connection member intersects through a plane defined by and parallel with the flat upper surface; and at least one user engagement member adjustably connected to the intermediate member, the at least one user engagement member comprising a first mounting extension, a second mounting extension, and a first handle having a first end and a second end, the first handle connected to the first mounting extension at the first end and the second mounting extension at the second end.

2. The exercise apparatus of claim 1, wherein the intermediate member is pivotable up to a maximum threshold angle about the pivot axis.

3. The exercise apparatus of claim 1, further comprising an elongate base attached to the support member to increase stabilization of the exercise apparatus.

4. The exercise apparatus of claim 3, wherein the intermediate member includes at least one vertical plate extending parallel with the support member.

5. The exercise apparatus of claim 4, further comprising a rotational restriction assembly disposed between the support member and the intermediate member.

6. The exercise apparatus of claim 3, further comprising at least one user stabilization handle connected to the base attached and extending upwardly therefrom.

7. The exercise apparatus of claim 6, comprising a first user stabilization handle and a second user stabilization handle, the first user stabilization handle attached to a first corner of the elongate base, and the second user stabilization handle attached to a second corner of the elongate base, wherein the first corner and second corner are on the same side of the intermediate member with respect to a length of the intermediate member.

8. The exercise apparatus of claim 1, wherein:

the intermediate member has a length perpendicular to the pivot axis;

the intermediate member includes a row of holes defined in the intermediate member, the row of holes extending along at a portion of the length of the intermediate member.

9. The exercise apparatus of claim 1, wherein the at least one user engagement member further comprises a second handle attached to the same first mounting extension as the first handle, the second handle positioned at an acute angle relative to the first handle.

10. The exercise apparatus of claim 1, wherein the intermediate member is biased toward a rest position.

11. The exercise apparatus of claim 10, wherein the intermediate member is biased toward the rest position by at least one spring.

12. The exercise apparatus of claim 11, wherein the intermediate member has multiple connection points, the spring configured to connect to the intermediate member at a given connection point of the multiple connection points.

13. A method of adjusting an exercise apparatus for unstable surface training, the method comprising:

(a) providing an intermediate member pivotable about a pivot axis, through a pivotal connection member that is coupled to a support member, the intermediate member including a flat upper surface transverse to a surface of the support member, the pivotal connection member arranged perpendicularly in contact with the intermediate member such that the pivot axis extends through a first plane defined by the surface of the support member, and the pivotal connection member intersects through a second plane defined by and parallel with the flat upper surface;

(b) providing at least one user engagement member secured to the intermediate member, wherein the at least one user engagement member comprises at least one mounting extension, the at least one mounting extension secured to the intermediate member via a pin;

(c) moving the at least one user engagement member along the length of the intermediate member from a first position to a second position; and (d) securing the at least one user engagement member in the second position.

14. The method of claim 13, further comprising freeing the user engagement member from the first position.

15. An exercise apparatus for unstable surface training comprising:

a support member;

an intermediate member pivotally connected to the support member about a pivot axis, the intermediate member including at least one vertical plate extending parallel with the support member;

at least one user engagement member adjustably connected to the intermediate member; and a rotational restriction assembly comprising a plurality of apertures defined in the support member and a lock pin connected to the vertical plate of the intermediate member, the lock pin configured to engage a given aperture of the plurality of apertures.

16. The exercise apparatus of claim 15, wherein the plurality of apertures includes at least one arcuate slot.

* * * * *